United States Patent [19]

Kirkland

[11] Patent Number: 4,972,388

[45] Date of Patent: Nov. 20, 1990

[54] ELECTRICAL CABLE MARKER

[75] Inventor: James L. Kirkland, Panama City, Fla.

[73] Assignee: The United States of Americas as represented by the Secretary of the Navy, Washington, D.C.

[21] Appl. No.: 550,886

[22] Filed: Feb. 13, 1975

[51] Int. Cl.[5] ..... F42B 22/42

[52] U.S. Cl. ..... 367/131; 102/402; 324/67

[58] Field of Search ..... 102/18 R, 18 MS, 402; 340/4 R; 324/67, 66; 367/131

[56] References Cited

U.S. PATENT DOCUMENTS 3,526,002 8/1970 Waddel ..... 340/852

3,597,680 8/1971 Haddon ..... 324/67

3,617,865 11/1971 Hakata ..... 324/67 X 3,641,427 2/1972 Pittman et al. ..... 367/134

*Primary Examiner*—Nelson Moskowitz

*Assistant Examiner*—Daniel T. Pihulic

*Attorney, Agent, or Firm*—Harvey David; John Becker; Sol Sheinbeing

[57] ABSTRACT

A marine mine control wire tagging system is disclosed as including a transmitter and a receiver, a mobile underwater vehicle having a launcher mounted thereon, a radio frequency signal tag loaded in said launcher, a sensor and a fire control system for launching said tag upon the detection of said marine mine control wire by the aforesaid sensor. If so desired, said transmitter and receiver may be mounted on a boat which also tows said underwater vehicle to a position in proximity with said control wire.

17 Claims, 1 Drawing Sheet

ELECTRICAL CABLE MARKER

STATEMENT OF GOVERNMENT INTEREST

The invention described herein may be manufactured and used by or for the Government of the United States of America for Governmental purposes without the payment of any royalties thereon or therefor.

FIELD OF THE INVENTION

In general, the present invention pertains to object taggers and, in particular, is an improved method and means for locating and tagging electrical conductors. In even greater particularity, the subject invention comprises a detector and tagger of the underwater control wires of electrically actuated marine mines, whenever said control wires are partially located under water and partially located in the atmosphere.

DESCRIPTION OF THE PRIOR ART

Heretofore, marine mine control wires have been detected, both within and out of water, by many different methods and means. However, no prior art is known which automatically tags such wires with radio frequency transmitters, once they have been detected. Of course, the tagging thereof did sometimes take place, but so doing was implemented by manually dropping buoy-type markers, weighted or otherwise, in the vicinity of the mines or wires already located. Such markers may have included anchor means, in the event they had to be deployed in water having a current; moreover, they sometimes contained radio or other types transmitters, in order to facilitate the subsequent homing thereon with complimentary equipment.

SUMMARY OF THE INVENTION

The present invention comprises a radio frequency signal sensor that detects radio frequency signals reradiated from the underwater portion of a marine mine control wire which were previously received from a radio transmitter by that portion thereof located in the atmosphere. A receiver and signal processor timely responds to the output of said sensor, closes a control switch, and supplies electrical power to an electrically detonated squib. Said squib detonation forces a tag containing a radio frequency transmitter and antenna means in proximity with the aforementioned detected control wire. When so deployed, the underwater portion of the control wire picks up the radio frequency signals broadcast by said tag and re-broadcasts them in the atmosphere by that portion thereof located in the atmosphere. Hence, to locate the marine mine control wire—and, thus, the marine mine—it only becomes necessary to home in on said rebroadcast radio signals with a direction finding radio.

Obviously, such method and means for locating and automatically tagging expedites the subsequent neutralization thereof, without undue hazzard to minesweeping personnel. Moreover, if properly designed and used—in such manner as will be more fully disclosed hereinafter—an element of covertness may be incorporated in the entire minesweeping operation, if so desired. It should, therefore, be readily appreciated that the instant invention provides advantages not obtainable from the devices of the prior art.

It is, therefore, an object of this invention to provide an improved electrical conductor tagging system.

Another object of this invention is to provide an improved method and means of tagging the underwater portion of a marine mine control wire, so that it may be relocated subsequently and destroyed or otherwise used at a more optimum time.

A further object of this invention is to provide a radio frequency signal wire tagging system that is activated by a predetermined interrogation signal.

A further object of this invention is to provide a radio frequency signal electrical conductor tagging system that automatically deploys a radio frequency signal tag upon the detection of said electrical conductor.

Still another object of this invention is to provide a method and means for tagging a particular electrical conductor, the detection of which is effected in accordance with a predetermined and programmed response signal.

Still another object of this invention is to detect and automatically tag the underwater portion of an electrical conductor having portions thereof disposed within water and within the atmosphere, respectively.

A further object of this invention is to provide an improved method and means for safely locating, tagging, and timely neutralizing control wire operated marine mines.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
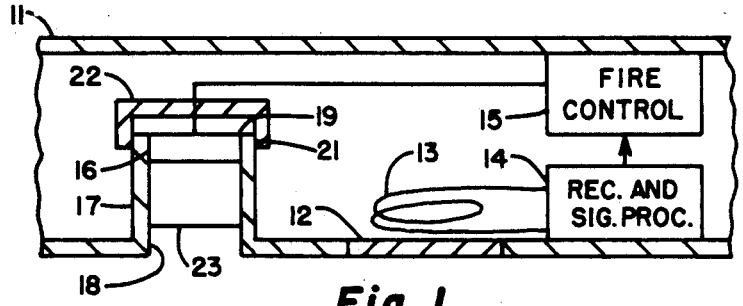
FIG. 1 is a cross-sectional, elevational view, with parts broken away, of a carrier vehicle which contains the subject invention.

Referring now to FIG. 1, there is shown a carrier vehicle 11 which, in this particular case, is presumed to have a streamline elongated geometrical configuration suitable for being pulled, pushed, or self-propelled through a predetermined fluid medium without being flooded thereby. As may readily be seen, the device of FIG. 1 has the ends thereof deleted; however, since the direction of travel thereof may be either left or right as desired, the end configurations therefor are left to the artisan designing them, so that they will be proper for the travel direction selected. Obviously, the making of such design choices would be well within the purview of one skilled in the art having the benefit of the teachings presented herewith.

The foregoing notwithstanding, for the purpose of keeping this disclosure as simple as possible, it will be presumed that the right end of carrier vehicle 11 is the forward end, and that carrier vehicle 11 is an underwater vehicle that is capable of being towed at a controlled attitude to a position near the bottom of a body of water, so as to place it in operative proximity with a marine mine control wire to be detected and tagged.

Because the attitude of vehicle 11 is controlled, a radio frequency energy clear window 12 is preferably located in the bottom thereof. Again, it should be understood that in this particular embodiment the wall of vehicle 11 is made of any appropriate plastic material which permits the penetration thereof by radio frequency electromagnetic energy; nevertheless, to facilitate the passing of such energy therethrough at a given location, window 12 is provided. A radio frequency energy sensor, such as an electrical coil 13, having a longitudinal axis that is normal to the longitudinal axis of carrier vehicle 11, is disposed in any conventional manner adjacent to the inside surface of window 12. Of course, the attitude thereof should be such as would facilitate the sensing and receiving of radio frequency (RF) energy from a source—such as, for example, a marine mine control wire energized by a radio frequency signal transmitter, to be discussed more fully below—located near the outside of said window 12.

RF coil sensor 13 is connected to the inputs of a receiver and signal processor 14 which is either responsive to a preprogrammed radio signal, produces a more suitable shape and level signal from the signal received thereby, or both. The output of receiver and signal processor 14 is connected to the input of a fire control circuit 15, the output of which is electrically connected to an electrically actuated or fired squib or explosive charge 16.

In this particular preferred embodiment of the invention, squib 16 is disposed within a barrel 17 having an end 18 that is open to the fluid environment ambient thereto—in this case, the water—and an open end 19 containing external threads 21 upon which a breechblock 22 is screwed, so as to effect the closure thereof when squib 16 has been loaded in barrel 17. Tag 23 is also loaded in barrel 17 in such manner that it may be ejected out of carrier vehicle 11 upon the firing of squib 16 or operation of any other ejection effecting means substituted for said squib 16 by the artisan.

Figure 2:
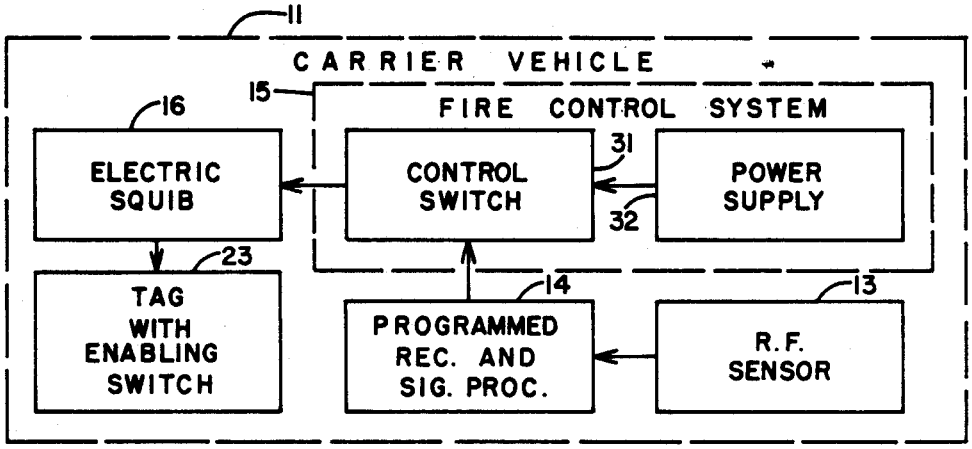
FIG. 2 is a generalized block diagram of the system constituting the invention.

Again, for the purpose of generalizing the aforementioned elements, their interconnections, and their interactions, said elements are depicted in block diagram form in FIG. 2, so as to allow the artisan sufficient lattitude in designing the system arrangement thereof to make them fit any desired operational situation. Accordingly, as they are shown, the reference numerals used therein are similar to those used for similar parts in FIG. 1.

In addition, the aforesaid fire control 15 is further broken down into its sub-components control switch 31 and power supply 32, which are connected as shown.

Figure 3:
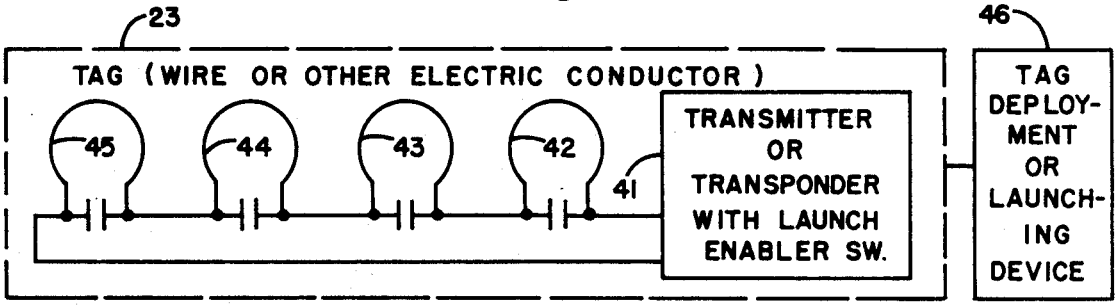
FIG. 3 is a combination block and schematic diagram of the tag of this invention and its deployment means.

FIG. 3 illustrates a representative embodiment of tag 18 of FIGS. 1 and 2. As may readily be seen, a radio frequency transmitter or transponder with launch enabling switch 41 is connected to a plurality of series connected loop or coil-like antennas 42 through 45. Of course, if a transmitter is employed, said antennas 42 through 45 are transmitting antennas, and if a transponder is employed, they are both receiving and transmitting antennas, as is conventional in the transponder act. Of course, both transmitter and transponder 41 may be designed to operate at any desired frequency, with the latter being subject to only intermittent interrogation as well, in the event optimum covertness of operation is desired.

Because, numerous conventional object launching devices and systems presently exist which may be selected for the purpose of timely and properly deploying tag 23, a tag deployment or launching device 46 is generally shown in block form association therewith. Hence, it should be understood that the launching apparatus depicted in FIG. 1 is not intended to be limiting, inasmuch as the selection thereof would ostensively be contingent upon the operational circumstances occurring at any given time and place.

Figure 4:
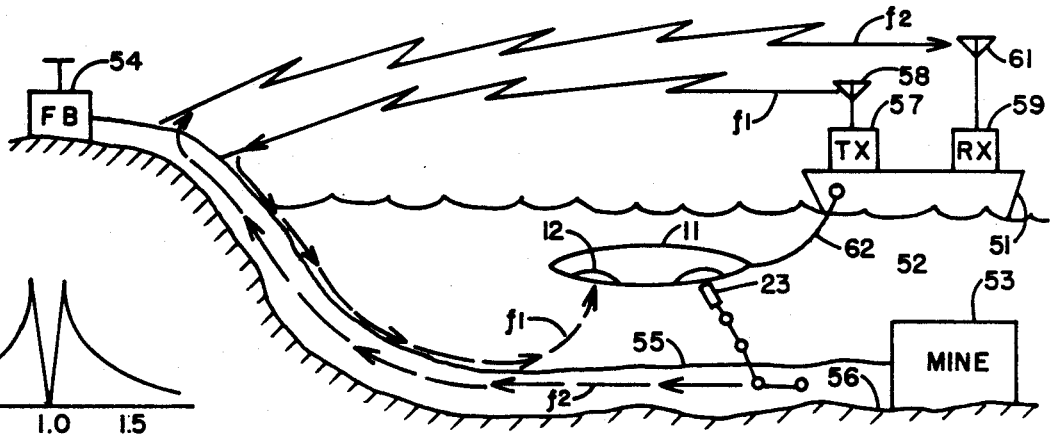
FIG. 4 is a quasi-pictorial view of a representative operational situation in which the instant invention may be used to an advantage.

FIG. 4, illustrating a simple but representative mine control wire tagging situation, will be discussed more fully below in conjunction with the discussion of the operation of the invention.

Figure 5:
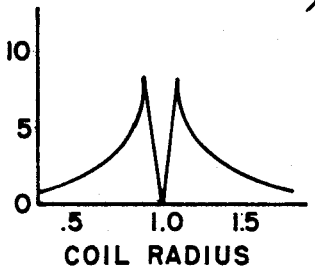
FIG. 5 is a graphical representation of an idealized signal waveform which may be the programmed waveform to which the subject invention has been designed to be responsive.

FIG. 5, disclosing a typical signal response to a wire being sensed by a loop receiving antenna (having a substantially circular horizontal plane configuration, for example) as RF sensor 13, will likewise be discussed further during the explanation of the operation of the invention presented subsequently.

Suffice to say at this time, that the marine mine control wire tagging system constituting this invention merely involves a new combination of old and well known elements which have been put together in a new and unique way, so as to produce results heretofore unobtainable from the devices of the prior art. Consequently, the method and means effected thereby ostensively makes a valuable contribution to the state of the art.

MODE OF OPERATION

The operation of the invention will now be discussed briefly in conjunction with all of the figures of the drawing.

Referring first to FIG. 4, there is shown a boat 51 which is traveling along a water course 52, within which it is suspected that a marine mine 53 has been laid. Of course, water course 52, may be a river, lake, estuary, bay, sea, ocean, or the like.

Obviously, in this particular case, marine mine 53 is of the type that is detonated as a result of electrical current being supplied thereto from a manually operated, operated firing box 54 via one or more electrical control wires 55. Of course, firing box 54 is located on land, while control wire 55 is located partially on land—that is, in the atmosphere—and partially located under water, since mine 53, to which it is connected, is located under water and usually rests on the bottom 56 thereof.

On board ship or boat 51 is a tunable radio transmitter 57 having a transmitting antenna 58 and a tunable radio receiver 59 having a direction finding receiving antenna 61. In this particular case, transmitter 57 and antenna 58 broadcast radio frequency energy at a predetermined frequency ($f_1$), and radio receiver 59 and antenna 61 receive radio frequency energy at a predetermined frequency ($f_2$) that is different from frequency $f_1$.

Also, as indicated carrier vehicle 11 is depicted as being an underwater vehicle that is towed by a cable 62. At this time, it would perhaps be noteworthy that cable 62 may be merely a tow cable or it may be a combination tow cable and electrical conductor means, depending on the physical arrangement of the various and sundry components of the subject system. For instance, if it is just a tow cable, then the system of FIG. 2 would be located within carrier vehicle 11, as indicated. On the other hand, if programmed receiver and signal processor 14, control switch 31, and power supply 32 were located in boat 51, then cable 62 would have to contain electrical wire conductors, as well as being a tow cable, in order for the remaining elements—viz., RF sensor 13 and electric squib 16—to be properly connected thereto electrically.

During marine mine wire tagging operations, transmitter 57 and antenna 58 broadcast radio signal $f_1$ throughout the environment surrounding boat 51. That portion of control wire 55 located in the atmosphere—say, that portion near and connected to fire box 54—receives radio signal $f_1$ and conducts it down along wire 55 toward mine 53. As it does so, it is radiated thereby within the water ambient thereto, and sensor 13 located in vehicle 11 picks it up.

The energization of sensor 13 by radiated radio frequency energy $f_1$, in turn, causes it to supply an electrical signal proportional thereto to programmed receiver and signal processor 14 which responds thereto by actuating control switch 31 in such manner as to complete the electrical circuit between power supply 32 and squib 16 and supply an electrical trigger signal thereto. Upon such circuit completion, electrical current ignites explosive squib 16, the explosion of which causes tag 23 to be turned on and launched in sufficient proximity with wire 55 to be electrically influenced thereby.

If component 41 of tag 23 is a transmitter, the continuous operation thereof causes radio antennas 42 through 45 to broadcast radio frequency energy $f_2$ toward control wire 55. Wire 55 picks it up from its underwater location and re-broadcasts it into the atmosphere from its on-land position. As a result, radio signal $f_2$ is received by scanning directional antenna 61 and radio receiver 59. Then, by homing in on signal $f_2$ with antenna 61, the exact location of control wire 55 becomes known by the people manning boat 51. Of course, such information becomes known because wire 55, in effect, has been tagged by radio frequency tag 23.

In the event it is desired to keep the tagging of wire 55 as covert as possible, component 41 of tag 23 may be designed to be a transponder. Accordingly, only when interrogated with a certain signal that has been received from the underwater portion of wire 55, then and only then does tag 23 broadcast its radio signal back thereto and, thus, to receiver 59. Of course, transmitter 57 and antenna 58 may be used to supply the aforesaid covert interrogation signal to transponder 41, if so desired; or, in the alternative, any other suitable radio transmitter may be employed for such purpose, if warranted by operational circumstances.

The waveform graphically represented in FIG. 5 is typical of the signal waveform acquired by sensor 13 as it passes over wire 55, as it is being towed along water course 52 by boat 51. If so desired, programmed receiver and signal processor 14 may be designed by the artisan to be responsive only to such signal, to any other signal waveform, or any and all signals. Hence, if any signal is received from wire 55 by sensor 13, it only need be processed to a more useful level and purity by receiver 14, in order to make the output therefrom adequate for closing switch 31. Obviously, it would be well within the purview for one skilled in the receiver art to design receiver 14 to be responsive to any desired signal.

Ancilliary to the aforementioned operation, it is possible to design tag 23 to broadcast radio frequency signal $f_2$ with such field strength as to cause mine 53 to be electrically detonated thereby, just as if it were fired by fire box 54. In the alternative, it appears to also be possible to detonate mine 53 by broadcasting radio signal $f_1$ with sufficient field strength to supply the necessary current through wire 55 to so do.

Although only one tag 23 is shown as being launched from carrier vehicle 11, any number thereof may be launched therefrom. Moreover, if more than one tag is launched, each thereof may be launched in response to a particular frequency signal that is different from the others, or they may all be launched by the same frequency signal.

Obviously, other modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A system for tagging an electrical conductor that partially extends within and partially extends out of a body of water, comprising in combination:

means spatially disposed from the aforesaid electrical conductor for broadcasting a first radio frequency signal to that portion thereof extending out of said body of water;

means spatially disposed from the aforesaid electrical conductor for receiving a second radio frequency signal from that portion thereof extending out of said body of water;

tag means adapted for timely broadcasting said second radio frequency signal to that portion of the aforesaid electrical conductor extending within said body of water upon the deployment thereof in proximity therewith;

means contiguously disposed with said tag means for effecting the deployment thereof in proximity with the aforesaid electrical conductor in response to a trigger signal; and means connected to said tag means deployment effecting means for sensing and receiving the aforesaid first radio frequency signal from that portion of said electrical conductor extending within said body of water and for supplying the aforesaid trigger signal to said tag deployment effecting means in timely response thereto

2. The system of claim 1, wherein said electrical conductor comprises a marine mine detonation effecting electric control wire.

3. The system of claim 1, wherein said means spatially disposed from the aforesaid electrical conductor for broadcasting a first radio frequency signal to that portion thereof extending out of said body of water comprises a radio transmitter means.

4. The system of claim 1, wherein said means spatially disposed from the aforesaid electrical conductor for receiving a second radio frequency signal from that portion thereof extending out of said body of water comprises a radio receiver means.

5. The system of claim 1, wherein said tag means adapted for timely broadcasting said second radio frequency signal to that portion of the aforesaid electrical conductor extending within said body of water upon the deployment thereof in proximity therewith comprises:

a radio transmitter; and transmitting radio antenna means connected to the output of said radio transmitter.

6. The system of claim 1, wherein said means contiguously disposed with said tag means for effecting the deployment thereof in proximity with the aforesaid electrical conductor in response to a trigger signal comprises:

an open-ended barrel, with one of the open ends thereof exposed to the water of said body of water, with the other end thereof containing external screw threads;

a breech block having internal screw threads screwed on the external screw threads of the other end of said barrel in such manner as to effect the closure of said other end thereof; and an explosive squib, having an insulated electrical conductor connected thereto for response to the aforesaid trigger signal and effectively extending through said breech block, disposed within said barrel between said breech block and said tag means when said tag means is loaded in said barrel.

7. The system of claim 1, wherein said means connected to said tag deployment effecting means for sensing and receiving the aforesaid first radio frequency signal from that portion of said electrical conductor extending within said body of water and for supplying the aforesaid trigger signal to said tag deployment effecting means in timely response thereto comprises:

a radio frequency signal sensor;

a programmable radio frequency signal receiver connected to the output of said radio frequency signal sensor;

a control switch having a pair of inputs and an output, with one of the inputs thereof connected to the output of said programmable radio frequency signal receiver, and with the output thereof connected to the trigger signal input of said tag deployment effecting means; and a power supply connected to the other input of the aforesaid control switch.

8. The switch of claim 1, wherein said means spatially disposed from the aforesaid electrical conductor for broadcasting a first radio frequency signal to that portion thereof extending out of said body of water comprises:

a marine vehicle adapted for traversing a predetermined course within said body of water; and a tunable radio transmitter means mounted on said marine vehicle in such manner as to timely broadcast said first radio frequency signal therefrom.

9. The system of claim 9 wherein said tunable radio transmitter means comprises:

a tunable radio transmitter; and a directional radio transmitting antenna connected to the output of said tunable radio transmitter.

10. The system of claim 1, wherein said means spatially disposed from the aforesaid electrical conductor for receiving a second radio frequency signal from that portion thereof extending out of said body of water comprises:

a marine vehicle adapted for traversing a predetermined course within said body of water; and a radio receiver means mounted on said marine vehicle in such manner as to timely receive said second radio frequency signal from that portion of said electrical conductor extending out of said body of water.

11. The system of claim 10, wherein said radio receiver means comprises:

a direction finding radio receiving antenna; and a tunable radio receiver connected to the output of said direction finding antenna.

12. The invention of claim 1, further characterized by means movable within said body of water for transporting said tag means deployment effecting means, said first radio frequency signal sensing means, and the aforesaid tag means to a position of influential proximity with said electrical conductor.

13. The invention of claim 12, wherein said transporting means comprises a mobile underwater vehicle.

14. The invention of claim 12, wherein said transporting means comprises:

an underwater vehicle; and a boat effectively connected to said underwater vehicle for the moving thereof along a predetermined course through the aforesaid body of water.

15. A method of tagging an electrical conductor that partially extends within and partially extends out of a body of water, comprising the steps of:

broadcasting a first radio frequency signal to that portion of said electrical conductor that extends out of said body of water, so as to cause it to be re-broadcast throughout the water ambient to that portion of said electrical conductor that extends within said body of water;

sensing and receiving said first radio frequency signal from within the water ambient to that portion of said electrical conductor which extends within said body of water and for producing a trigger signal in response thereto; and deploying a second radio frequency signal broadcasting tag in influential proximity with the underwater portion of said electrical conductor in response to said trigger signal, so as to cause said underwater portion of said electrical conductor to receive said second radio frequency signal and re-broadcast it by that portion thereof which extends out of said body of water.

16. The method of claim 15, further characterized by sensing and receiving the aforesaid second radio frequency signal that has been re-broadcast by that portion of said electrical conductor that extends out of said body of water in such manner as to measure the direction from which it has been rebroadcast, thereby effectively indicating the location where that portion of said electrical conductor that extends out of said body of water.

17. A system for locating the position of a marine mine control wire, a portion of which extends within water and a portion of which extends out of said water, comprising in combination:

a boat;

a transmitter means mounted on said boat for broadcasting a first radio signal;

an underwater vehicle movable into proximity with the underwater portion of said marine mine control wire by said boat;

a launcher, having a trigger input, mounted on said underwater vehicle;

a tag loaded in said launcher for timely broadcasting a second radio signal upon being launched thereby;

a sensor, responsive to said first radio signal, mounted on said underwater vehicle;

a programmable receiver and signal processor connected to the output of said sensor;

a control switch having a control input, a power input, and an output, with the control input thereof connected to the output of said programmable receiver and signal processor;

a power supply connected to the power input of said control switch;

means connected between the output of said control switch and the trigger of the aforesaid launcher for effecting the launching of said tag toward the underwater portion of said marine mine control wire upon the sensing of said first radio signal by said sensor; and a receiver means mounted on said boat for receiving said second radio signal.

* * * * *